US011203922B1

(12) United States Patent
Sun et al.

(10) Patent No.: US 11,203,922 B1
(45) Date of Patent: Dec. 21, 2021

(54) METHOD AND EQUIPMENT FOR OPTIMIZING HYDRAULIC PARAMETERS OF DEEPWATER MANAGED PRESSURE DRILLING IN REAL TIME

(71) Applicants: China University of Petroleum (East China), Qingdao (CN); Zhanjiang Branch of CNOOC (China) Co., Ltd, Zhanjiang (CN)

(72) Inventors: Baojiang Sun, Qingdao (CN); Zhiyuan Wang, Qingdao (CN); Shujie Liu, Zhanjiang (CN); Yonghai Gao, Zhanjiang (CN); Baitao Fan, Zhanjiang (CN); Hao Li, Qingdao (CN); Shen Guan, Zhanjiang (CN); Haikang He, Qingdao (CN); Bangtang Yin, Qingdao (CN); Xiaohui Sun, Qingdao (CN); Xuerui Wang, Qingdao (CN)

(73) Assignees: China University of Petroleum (East China), Qingdao (CN); Zhanjiang Branch of CNOOC (China) Co., Ltd, Zhanjiang (CN)

( * ) Notice: Subject to any disclaimer, the term of this patent is extended or adjusted under 35 U.S.C. 154(b) by 0 days.

(21) Appl. No.: 17/206,386

(22) Filed: Mar. 19, 2021

(30) Foreign Application Priority Data

Dec. 17, 2020 (CN) ..... 202011501864.3

(51) Int. Cl.
*E21B 43/12* (2006.01)
*E21B 21/08* (2006.01)
(Continued)

(52) U.S. Cl.
CPC ..... *E21B 43/12* (2013.01); *E21B 21/001* (2013.01); *E21B 21/08* (2013.01); *E21B 21/082* (2020.05);
(Continued)

(58) Field of Classification Search
CPC ..... E21B 33/035; E21B 34/02; E21B 34/04; E21B 43/12; E21B 21/08
See application file for complete search history.

(56) References Cited

U.S. PATENT DOCUMENTS 10,337,267 B1 * 7/2019 Wang ..... E21B 21/08
2012/0292109 A1 * 11/2012 Lovorn ..... E21B 21/08 175/25

(Continued)

*Primary Examiner* — Tara Schimpf
(74) *Attorney, Agent, or Firm* — Volpe Koenig

(57) ABSTRACT

The present invention provides a method and equipment for optimizing hydraulic parameters of deepwater managed pressure drilling in real time. The method comprises: acquiring overflow parameters in the current drilling process, performing preprocessing and feature extraction on the overflow parameters, and inputting the overflow parameters into trained support vector machine identification models for overflow judgment. If overflow occurs at the current drilling depth, reducing an opening of a throttle valve and increasing a displacement of a submarine pump, measuring a wellhead back pressure and calculating a bottom hole pressure, and judging whether overflow continues is performed. If overflow continues, mixing high-density drilling fluid with the original drilling fluid, pumping the mixture into a wellbore annulus, and performing the above operations of reducing the throttle valve opening, increasing the displacement of the submarine pump, calculating the bottom hole pressure and judging whether overflow continues is performed until overflow no longer occurs.

8 Claims, 3 Drawing Sheets

(51) Int. Cl.

| | |
|---|---|
| ***E21B 21/00*** | (2006.01) |
| ***F04B 49/06*** | (2006.01) |
| ***F04B 49/22*** | (2006.01) |
| ***E21B 33/035*** | (2006.01) |
| ***E21B 34/02*** | (2006.01) |
| ***E21B 34/04*** | (2006.01) |
| *E21B 47/06* | (2012.01) |

(52) U.S. Cl.
CPC ..... *E21B 33/035* (2013.01); *E21B 34/02* (2013.01); *E21B 34/04* (2013.01); *F04B 49/065* (2013.01); *F04B 49/225* (2013.01); *E21B 47/06* (2013.01); *E21B 2200/20* (2020.05)

(56) References Cited

U.S. PATENT DOCUMENTS

| | | | | |
|---|---|---|---|---|
| 2014/0262246 | A1* | 9/2014 | Li | E21B 49/00 166/250.08 |
| 2018/0171769 | A1* | 6/2018 | Gu | E21B 43/267 |
| 2020/0362650 | A1* | 11/2020 | Li | E21B 21/08 |
| 2021/0133368 | A1* | 5/2021 | Al Shammari | E21B 41/00 |

* cited by examiner

METHOD AND EQUIPMENT FOR OPTIMIZING HYDRAULIC PARAMETERS OF DEEPWATER MANAGED PRESSURE DRILLING IN REAL TIME

CROSS REFERENCE TO RELATED APPLICATIONS

This application claims priority to Chinese Application No. 202011501864.3, filed on Dec. 17, 2020, which is specifically and entirely incorporated by reference.

FIELD OF THE INVENTION

The present invention relates to the field of ocean deepwater oil and gas drilling engineering, and in particular, to a method and equipment for optimizing hydraulic parameters of deepwater managed pressure drilling in real time based on a dual-multi model and big data fusion.

BACKGROUND OF THE INVENTION

The rapid development of economy has increased the dependence of human beings on oil and gas resources year by year. With the continuous exhaustion of land oil and gas exploration reserves, the development potential has been greatly reduced. Maintaining the steady growth of oil and gas must rely on the safe and efficient development of marine oil and gas. As of 2018, according to the statistics of International Energy Agency (IEA), the reserves of marine natural gas are 95 trillion cubic meters, accounting for 57.2% of the global total reserves, of which the proven rate is 30.6%. Therefore, the exploration and development of the marine natural gas has a very broad prospect. In the development process of the marine natural gas resources, there are many risks, such as harsh deepwater environment, abnormal high stratum pressure, extremely narrow density window, formation of hydrate in low-temperature and high-pressure environment near the mud line, decomposition inflow of the hydrate when the hydrate reservoir is drilled through and invasion of acid gases such as $CO_2$ and $H_2S$ in the stratum. Meanwhile, in the deepwater drilling process, the wellhead is generally located at the bottom of the well, the long-distance throttle pipeline causes huge pressure loss, and downhole accidents such as well kick, circulation loss, well wall collapse, tool sticking and the like occur frequently. Especially in the stratum with extremely narrow pore pressure and fracture pressure, the occurrence of downhole accidents seriously increases the non-operation time, reduces the drilling efficiency and increases the drilling cost. Due to the above characteristics in the development process of the deepwater natural gas field, it is difficult to analyze the abnormal condition in the well through measurement while drilling and it is impossible to effectively monitor early overflow. At the same time, the drilling technology theory of the marine natural gas field is complicated and interwoven, which brings severe challenges to the managed pressure drilling of the marine natural gas field. If the complex flow situation in the wellbore cannot be reflected accurately and timely, the drilling accident will bring huge economic losses and casualties.

SUMMARY OF THE INVENTION

The embodiment of the present invention provides a method for optimizing hydraulic parameters of deepwater managed pressure drilling in real time. The method comprises the following steps: acquiring overflow parameters in the current drilling process in real time, performing preprocessing and feature extraction on the overflow parameters, and inputting the overflow parameters after preprocessing and feature extraction into trained support vector machine identification models for overflow judgment; when it is judged that overflow occurs at the current drilling depth, reducing the opening of a throttle valve on a throttle pipeline, increasing a wellhead back pressure, and increasing a displacement of a submarine pump and a displacement of drilling fluid, measuring the wellhead back pressure and calculating a bottom hole pressure according to the measured wellhead back pressure, and judging whether overflow continues to occur in case that the calculated bottom hole pressure does not fall into a safety window; under the condition that overflow continues to occur, mixing high-density drilling fluid with the original drilling fluid, pumping the mixture into a wellbore annulus from a drill pipe, and performing the above operations of reducing the opening of the throttle valve, increasing the displacement of the submarine pump, calculating the bottom hole pressure and judging whether overflow continues to occur until overflow no longer occurs.

Optionally, the trained support vector machine identification models comprise: a flow identification model, a mud pit increment identification model and a standpipe pressure identification model; and the step of acquiring overflow parameters in the current drilling process in real time, performing preprocessing and feature extraction on the overflow parameters, and inputting the overflow parameters after preprocessing and feature extraction into trained support vector machine identification models for overflow judgment comprises: acquiring a flow differential of an inlet and an outlet, a mud pit increment and a standpipe pressure in the current drilling process in real time, performing preprocessing and feature extraction on the flow differential, the mud pit increment and the standpipe pressure, inputting the flow differential, the mud pit increment and the standpipe pressure after preprocessing and feature extraction into corresponding support vector machine identification models for overflow judgment, and processing an overflow probability under each identification model by an information fusion model to judge whether overflow occurs at the current drilling well depth.

Optionally, the step of calculating a bottom hole pressure according to the measured wellhead back pressure comprises: determining flow calculation parameters after overflow of the managed pressure drilling; determining complex fluid components in the overflow state; establishing a wellbore dual-multi model by considering the complex flow in a wellbore in the overflow state; determining a core auxiliary equation and a boundary condition; performing grid partition and numerical discrete on a solution domain of the dual-multi model; and solving the dual-multi model to obtain the bottom hole pressure under the current measured wellhead back pressure.

Optionally, the flow calculation parameters comprise: a wellbore structure, a drilling tool assembly, stratum data, a gas-liquid-solid phase displacement monitored on a drilling platform, a drilling fluid density, a drilling fluid viscosity, a real-time wellhead back pressure, a wellhead temperature and pressure and the current drilling depth of a drill bit; the complex fluid components comprise: drilling fluid, inflow crude oil, stratum water, broken rock debris, hydrate, hydrocarbon gas, $CO_2$ and $H_2S$ when a hydrate layer is drilled through.

Optionally, the wellbore dual-multi model comprises: continuity equations of a gas phase, a liquid phase, a solid phase and a supercritical phase, a momentum equation and an energy equation.

The embodiment of the present invention provides an equipment for optimizing hydraulic parameters of deepwater managed pressure drilling in real time, the equipment comprising: a meter configured to measure overflow parameters and a wellhead back pressure in the current drilling process in real time; and a controller configured to perform preprocessing and feature extraction on the overflow parameters, inputting the overflow parameters after preprocessing and feature extraction into trained support vector machine identification models for overflow judgment, when it is judged that overflow occurs at the current drilling depth, perform the following operations: reducing the opening of a throttle valve on a throttle pipeline, increasing a wellhead back pressure and increase a displacement of a submarine pump and a displacement of drilling fluid, calculating a bottom hole pressure according to the collected wellhead back pressure, judging whether overflow continues to occur in case that the calculated bottom hole pressure does not fall into a safety window; and under the condition that overflow continues to occur, mixing high-density drilling fluid with the original drilling fluid, pumping the mixture into a wellbore annulus from a drill pipe, and performing the above operations of reducing the opening of the throttle valve, increasing the displacement of the submarine pump, calculating the bottom hole pressure and judging whether overflow continues to occur until overflow no longer occurs.

Optionally, the trained support vector machine identification models comprise: a flow identification model, a mud pit increment identification model and a standpipe pressure identification model; the meter is configured to measure a flow differential of an inlet and an outlet, a mud pit increment and a standpipe pressure in the current drilling process in real time; and the controller is configured to perform preprocessing and feature extraction on the flow differential, the mud pit increment and the standpipe pressure, input the flow differential, the mud pit increment and the standpipe pressure after preprocessing and feature extraction into corresponding support vector machine identification models for overflow judgment to obtain an overflow probability under each identification model, and process the overflow probability under each identification model by an information fusion model to judge whether overflow occurs at the current drilling well depth.

Optionally, the operation of calculating a bottom hole pressure according to the collected wellhead back pressure comprises: determining flow calculation parameters after overflow of the managed pressure drilling; determining complex fluid components in the overflow state; establishing a wellbore dual-multi model by considering the complex flow in a wellbore in the overflow state; determining a core auxiliary equation and a boundary condition; performing grid partition and numerical discrete on a solution domain of the dual-multi model; and solving the dual-multi model to obtain the bottom hole pressure under the current measured wellhead back pressure.

Optionally, the flow calculation parameters comprise: a wellbore structure, a drilling tool assembly, stratum data, a gas-liquid-solid phase displacement monitored on a drilling platform, a drilling fluid density, a drilling fluid viscosity, a real-time wellhead back pressure, a wellhead temperature and pressure and the current drilling depth of a drill bit; the complex fluid components comprise: drilling fluid, inflow crude oil, stratum water, broken rock debris, hydrate, hydrocarbon gas, $CO_2$ and $H_2S$ when a hydrate layer is drilled through.

Optionally, the wellbore dual-multi model comprises: continuity equations of a gas phase, a liquid phase, a solid phase and a supercritical phase, a momentum equation and an energy equation.

By the above technical solution, the following technical effects can be achieved:

(1) according to the present invention, the method for optimizing the hydraulic parameters of the deepwater managed pressure drilling in real time is suitable for drilling and development of deepwater natural gas fields, and early monitoring of overflow is realized by a big data fusion method, so that early detection and early handling are ensured, and safe managed pressure drilling is maintained;

(2) through consideration on the influence of the existence of multiple phases and multiple components in the wellbore in the deepwater drilling process, the present invention is suitable for the drilling and development of the deepwater natural gas fields and is also suitable for safe managed pressure drilling of the marine hydrate layer, the land frozen soil zone and the natural gas field with high temperature, high pressure and high acid gas content; and (3) according to the present invention, the overflow working condition in the drilling process of the deepwater gas well is considered, for the overflow handling, the complex flow state in the wellbore is calculated and analyzed by the dual-multi model in real time, the pressure change in the section difficult in measurement while drilling in the wellbore is accurately grasped, the bottom hole pressure is regulated and controlled in the appropriate safe window in real time according to three pressure prediction profiles of the stratum, the calculation precision is high, and the overflow situation in the managed pressure drilling process can be handled in real time. Other features and advantages of the embodiment of the present invention will be described in detail in the following specific implementation parts.

BRIEF DESCRIPTION OF DRAWINGS

The accompanying drawings are intended to provide further understanding of the embodiment of the present invention, constitute a part of the specification, and together with the following specific embodiments, are used to explain the embodiments of the present invention, but do not constitute a limitation to the embodiments of the present invention. In the accompanying drawings.

DETAILED DESCRIPTION OF THE EMBODIMENTS

Figure 1:
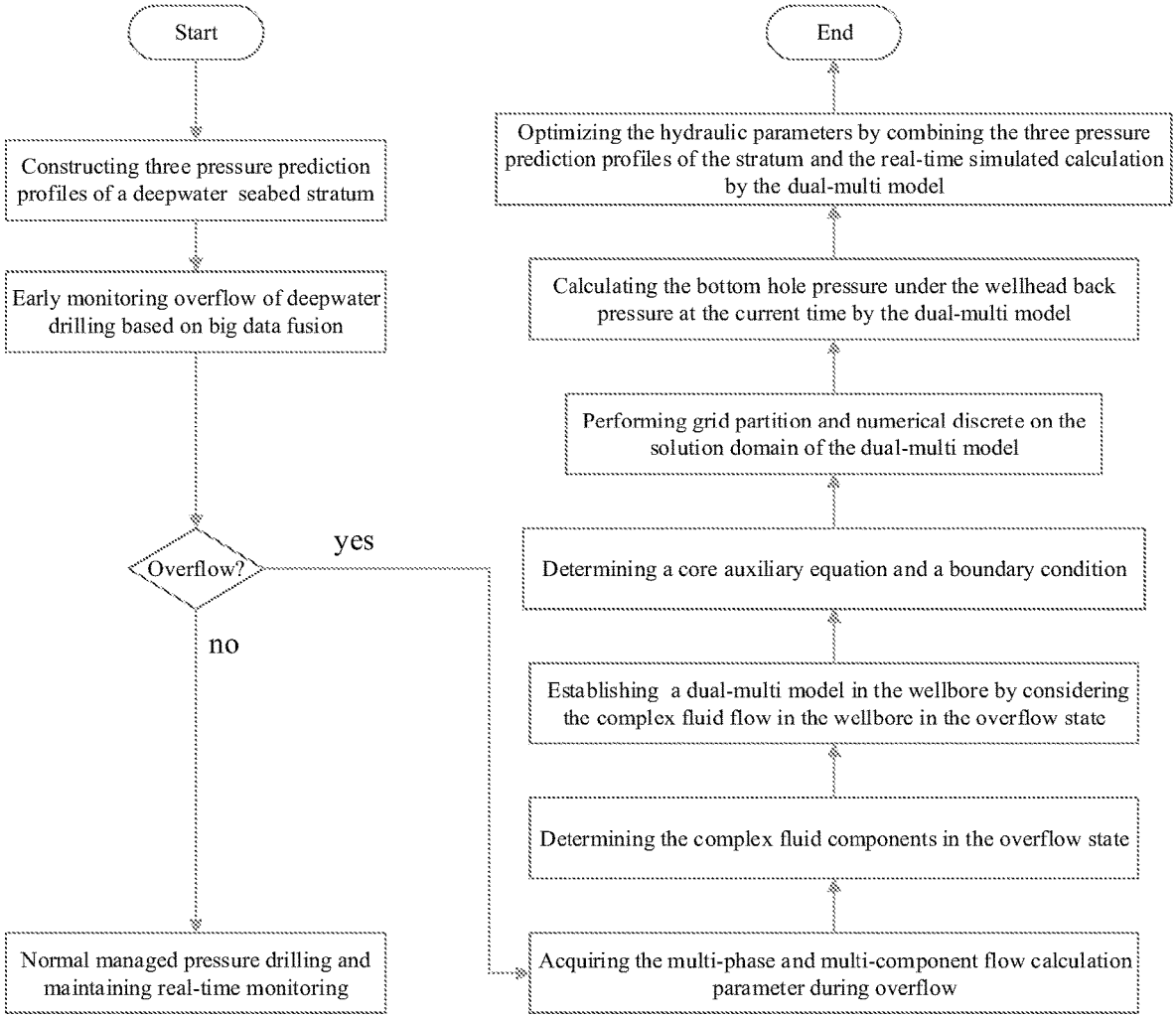
FIG. 1 is a flowchart of real-time optimization of hydraulic parameters of deepwater managed pressure drilling based on a dual-multi model and big data fusion.

The specific implementations of embodiments of the present invention are described below in detail with reference to the accompanying drawings. It should be understood that the specific embodiments described herein are only used to illustrate and interpret the present invention and are not intended to limit the embodiments of the present invention.

The marine managed pressure drilling technology can meet the requirements of exploration and development of the natural gas field under the complex marine drilling environment. The existing domestic and foreign marine managed pressure drilling technology applications, which are mainly focused on the double-gradient drilling and control mud cap drilling technologies and mainly aim at single-phase flow of the drilling fluid in the wellbore and gas-liquid two-phase flow under the gas injection working condition, have high dependence degree on data of well logging during drilling. Meanwhile, the overflow monitoring method adopted in the drilling site is mainly focused on a threshold method, so the false alarm rate is high. In the aspect of the managed pressure drilling theoretical technology, the existing land managed pressure drilling technology considers the dissolution and precipitation of the acid gas with high $CO_2$ and $H_2S$ content in the drilling fluid, but ignores the influence of the phase change of the acid gas in the wellbore and the formation of the natural gas hydrate in the high-pressure and low-temperature environment near the seabed mud line on the pressure of the wellbore. Therefore, it is of great significance to realize the early monitoring of overflow in the wellbore by the big data fusion analysis method and calculate the pressure of the wellbore in real time by the wellbore multi-component and multi-phase flow model aiming at the found overflow working condition so as to realize accurate managed pressure drilling and timely discover and handle the abnormal condition.

In view of the problems of the managed pressure drilling theory and the early monitoring of overflow when the deepwater natural gas field is drilled to the reservoir and the hydrate reservoir is penetrated in the drilling process, the present invention provides a method for optimizing hydraulic parameters of deepwater managed pressure drilling in real time based on a dual-multi model and big data fusion. The method specifically comprises:

1. Constructing Three Pressure Prediction Profiles of a Deepwater Seabed Stratum The three pressure prediction profiles of the deepwater seabed stratum are constructed according to logging information and adjoining well data before drilling on the platform.

2. Early Monitoring Overflow of Deepwater Drilling Based on Big Data Fusion

A database is formed by historical drilling data of the current development block and deepwater drilling overflow data in the existing literature, data of the database are subjected to preprocessing and feature extraction and are trained by a support vector machine, a kernel function in the support vector machine is optimized by a particle swarm algorithm at the same time to obtain optimal trained support vector machine models, overflow parameters in the current drilling process are acquired in real time and are input into the trained support vector machine identification models for overflow judgment after preprocessing and feature extraction to obtain an overflow probability under each identification model, finally whether overflow occurs at the current drilling well depth is judged by an information fusion model, overflow handling is performed if overflow is monitored, and normal drilling is performed if overflow is not monitored.

3. Maintaining Safe Managed Pressure Drilling when Overflow is not Monitored

When overflow at the current drilling depth is not monitored through an overflow risk judgment method, the managed pressure drilling shall be continued in combination with the three pressure profiles of stratum.

4. Performing Real-Time Simulated Calculation on a Bottom Hole Pressure when Overflow is Monitored When overflow is monitored to occur at the current drilling depth, the complex flow state in the wellbore is analyzed, a dual-multi model of the wellbore (that is, an eight-component four-phase flow control equation set) is established, and the bottom hole pressure under the current wellhead back pressure is calculated. The step of predicting the bottom hole pressure in real time by the dual-multi model is as follows:

(1) flow calculation parameters after overflow of the managed pressure drilling are determined. The calculation parameters mainly comprise: a wellbore structure, a drilling tool assembly, stratum data, a gas-liquid-solid phase displacement monitored on a drilling platform, a drilling fluid density, a drilling fluid viscosity, a real-time wellhead back pressure, a wellhead temperature and pressure and the current drilling depth of a drill bit.

(2) Complex fluid components in the overflow state are determined. The complex fluid components are focused on eight components, specifically comprising: drilling fluid, inflow crude oil, stratum water, broken rock debris, hydrate, hydrocarbon gas, $CO_2$ and $H_2S$ when a hydrate layer is drilled through.

(3) A wellbore dual-multi model is established by considering the complex flow in the wellbore in the overflow state. The multiple phases in the wellbore are mainly focused on a gas phase, a liquid phase, a solid phase and a supercritical phase, and the dual-multi model comprises continuity equations of a gas phase (hydrocarbon gas, $CO_2$ and $H_2S$ invaded in the stratum), a liquid phase (drilling fluid, produced stratum water and crude oil), a solid phase (rock debris and a hydrate phase) and a supercritical phase, a momentum equation and an energy equation.

(4) A core auxiliary equation and a boundary condition are determined. To realize accurate solution of the multi-component and multi-phase flow control equation set established in (3), it is necessary to establish a certain calculation auxiliary equation and determine an initial boundary condition, wherein the core auxiliary equation comprises: a hydrate formation and decomposition equation, a solubility calculation equation of hydrocarbon gases ($CH_4$, $C_2H_6$, $C_3H_8$, etc.) and acid gases ($CO_2$, $H_2S$), a supercritical phase discrimination equation, a stratum hydrocarbon gas production equation, a stratum acid gas production equation, etc.

(5) A solution domain of the dual-multi model is subjected to grid partition and numerical discrete. The established dual-multi model is subjected to grid partition of a time domain and a space domain in the wellbore to determine a time step length and a space step length. Meanwhile, the continuity equation, the momentum equation and the energy equation in the dual-multi model are subjected to numerical discrete by a four-point finite difference method.

(6) The bottom hole pressure under the current measured wellhead back pressure is obtained by solving the dual-multi model. According to the obtained three pressure prediction profiles of the stratum, an initial value of the bottom hole pressure is assumed in real time, the dual-multi model is solved to obtain the bottom hole pressure under the current wellhead back pressure value and obtain a multi-phase flow parameter in the wellbore. The multi-phase flow parameter comprises: temperature and pressure distribution in a wellbore annulus and volume fraction of each phase and each component.

5. Optimizing the hydraulic parameters by combining the three pressure prediction profiles of the stratum and the real-time simulated calculation by the dual-multi model. The safe drilling pressure window at the current well depth is obtained through three pressure prediction profiles of the stratum. The marine drilling platform rapidly adjusts the density of the drilling fluid, the opening of the throttle valve and the displacement of the submarine pump and accurately controls the bottom hole pressure to ensure that the bottom hole pressure is within an appropriate safe window.

6. Performing Real-Time Overflow Monitoring and Real-Time Calculation by the Dual-Multi Model to Realize Safe and Efficient Drilling In combination with the early monitoring of overflow and calculation on the bottom hole pressure by the dual-multi model when overflow occurs, the hydraulic parameters are adjusted in real time according to the three pressure profiles of the stratum (an appropriate safe pressure window can be determined according to the three pressure profiles of the stratum), and safe and efficient managed pressure drilling is maintained.

FIG. 1 is a calculation flowchart of a method for optimizing hydraulic parameters of marine managed pressure drilling in real time based on a multi-component and multi-phase flow model. The main implementation steps are as follows:

1. Construction of Three Pressure Prediction Profiles of a Deepwater Seabed Stratum The three pressure prediction profiles of the deepwater seabed stratum are constructed according to logging information and adjoining well data before drilling on the platform.

2. Early Monitoring of Overflow of Deepwater Drilling Based on Big Data Fusion (1) A database is formed by historical drilling data of the current development block and deepwater drilling overflow data in the existing literature, data of the database are subjected to preprocessing and feature extraction, and an error penalty factor and a nuclear parameter in a support vector machine (SVM) are optimized by a particle swarm algorithm to obtain the optimal trained support vector machine overflow identification modules (a flow identification model, a mud pit increment identification model and a standpipe identification model);

(2) the overflow parameters (a flow differential of an inlet and an outlet, a mud pit increment and a standpipe pressure) in the current drilling process are acquired in real time and are input into the trained support vector machine (SVM) identification models after preprocessing and feature extraction for overflow judgment to obtain an overflow probability under each identification model; and (3) whether overflow occurs at the current drilling well depth is judged by an information fusion model, overflow handling is performed if overflow is monitored, and normal drilling is performed if overflow is not monitored.

Preprocessing in (1) adopts Fourie transform filtering and noise reduction processing, abnormal points with large fluctuation are removed, and monitoring parameters with small fluctuation are subjected to smoothing processing by a mean filtering method:

$$f_n = \frac{1}{N}\sum_{k=0}^{N-1} F(k) W_N^{-kn}$$

herein, $f_n$ is data after filter change; F(k) is a finite length sequence with a length M; N is an interval length of Fourie transform, wherein N>M; k=0, 1, 2, . . . N−1 is a frequency variable; and $W_N$ is a rotation factor and n is a time variable.

The feature extraction of the obtained data in (1) mainly aims at the representation of variation of each overflow monitoring parameter within a certain time, optimization of the support vector machine (SVM) by the particle swarm algorithm mainly aims at the error penalty factor C and the nuclear parameter $\sigma^2$, and a fitness function of the support vector machine is as follows:

$$f_{fit} = \frac{1}{n}\sum_{i=1}^{n} |y_i - y_i|$$

wherein n is sample capacity, $y_i$ is training set output, $\overline{y}_i$ is optimization output, and after specified iterations are reached, optimization output of the optimal parameter is stopped to obtain the optimal support vector machine model.

The information fusion model for overflow judgment in (3) is mainly focused on D-S multi-source information. Firstly, according to the overflow probability under each identification model obtained in (2), a normalization constant is calculated:

$$K = 1 - \sum_{flow \cap no_flow} \prod_{i=1}^{2} m_i(A_i)$$

wherein K is normalization constant; $m_i(A_i)$ is occurrence probability of overflow or non-overflow; in $A_i$, i=1 represents overflow event, and i=2 represents non-overflow event; flow is overflow state; no flow is non-overflow state.

The obtained overflow occurrence probability M (flow) is:

$$M(flow) = \frac{1}{K} \sum_{flow \cap no_flow = \{flow\}} \prod_{i=1}^{2} m_i(A_i)$$

if the probability after fusion is higher than a certain threshold (for example, 0.5), it shows that overflow occurs in the managed pressure drilling process; and if the probability after fusion is lower than the threshold (for example, 0.5), normal managed pressure drilling is performed and no overflow occurs.

3. Real-Time Simulated Calculation of the Bottom Hole Pressure when Overflow is Monitored (1) Determination of flow calculation parameters during overflow Multi-phase flow calculation parameters of the deepwater managed pressure drilling are obtained, wherein the calculation parameters mainly comprise: a wellbore structure, a drilling tool assembly, stratum data, a gas-liquid-solid phase displacement in drilling, physical data of drilling fluid, real-time wellhead back pressure, temperature and pressure at the seabed mud line wellhead and the current drilling depth of the drill bit.

(2) Determination of Complex Fluid Components in the Overflow State

When overflow occurs, the fluid in the wellbore are focused on 8 components, specifically comprising: drilling fluid, inflow crude oil, stratum water, broken rock debris, hydrate, hydrocarbon gas, $CO_2$ and $H_2S$ when a hydrate layer is drilled through.

(3) Establishment of a Dual-Multi Model in the Wellbore by Considering the Complex Fluid Flow in the Wellbore in the Overflow State For the complex situation of the fluid components and the flow state in the marine managed pressure drilling process, a dual-multi model in the wellbore is established. The "dual-multi" in the model refers to eight-component and four-phase flow, specifically comprising: a gas phase (hydrocarbon gas, $CO_2$ and $H_2S$ invaded in the stratum), a liquid phase (drilling fluid and produced stratum water), a solid phase (rock debris and a hydrate phase) and a supercritical phase. The dual-multi model contains continuity equations of the four phases, a total momentum equation and an energy equation. Parameters required by calculation comprise: the densities $\rho_m$, $\rho_w$, $\rho_c$, $\rho_g$, $\rho_{CO2}$, $\rho_H$, $\rho_{SC}$, $\rho_o$ and $\rho_{H2S}$ (kg/m$^3$) of the drilling fluid, stratum water, rock debris, stratum hydrocarbon gas, $CO_2$, hydrate phase, supercritical phase, crude oil and $H_2S$ at the local temperature and pressure; the local up-hole velocities $v_m$, $v_w$, $v_c$, $v_g$, $v_{CO2}$, $v_H$, $v_{SC}$, $v_o$ and $v_{H2S}$ (m/s) of the drilling fluid, stratum water, rock debris, stratum hydrocarbon gas, $CO_2$, hydrate phase, supercritical phase, crude oil and $H_2S$; the local volume fractions $E_m$, $E_w$, $E_c$, $E_g$, $E_{CO2}$, $E_H$, $E_{SC}$, $E_O$ and $E_{H2S}$ (non-dimensional) of the drilling fluid, stratum water, rock debris, stratum hydrocarbon gas, $CO_2$, hydrate phase, supercritical phase, crude oil and $H_2S$; the sectional area A (m$^2$) of the annulus; the mass $q_g$ (kg/s·m$^3$) of natural gas ($CH_4$, $C_2H_6$ and $C_3H_8$) produced per unit time and per unit thickness; the mass fraction $x_g$ (zero dimension) of the natural gas in the hydrate; the formation/decomposition rate of $r_H$ (kg/s·m) of the hydrate of the natural gas per unit length in the wellbore; the formation/decomposition rate $r_{sc}$ (kg/s·m) of the supercritical phase per unit length in the wellbore; the mass $q_c$, $q_w$, $q_{CO2}$, $q_{H2S}$, $q_o$, $q_{SC}$ (kg/s) of the rock debris, produced water, $CO_2$, $H_2S$, crude oil and supercritical phase per unit thickness; the solubility $R_i$ (m$^3$/m$^3$) of the natural gas (i=$CH_4$, $C_2H_6$ and $C_3H_8$) in the drilling fluid; the density $\rho_{gi}$ (kg/m$^3$) of the natural gas (i=$CH_4$, $C_2H_6$ and $C_3H_8$) in the standard state; the solubility of $R_i$ (m$^3$/m$^3$) of the acid gas (i=$CO_2$ and $H_2S$) in the drilling fluid; an angle of inclination $\alpha$ (°); pressure P, Pa; coordinates z and m in the flow direction; gravitational acceleration g (m/s$^2$), and annulus friction $F_r$ (Pa); temperature T (° C.) in the annulus; stratum temperature $T_{ei}$ (° C.); temperature $T_t$ (° C.) in the drill pipe; the decomposition heat $\Delta H_H$ (J/mol) of the hydrate phase, the average mean molecular weight $M_H$ of the hydrate phase, the decomposition heat $\Delta H_{SC}$ (J/mol) of the supercritical phase, and the average mean molecular weight $M_{SC}$ (kg/mol) of the supercritical phase; the mass flow rate w (kg/s) of the fluid; the specific heat capacity C (J/kg° C.) of the fluid; the volume fraction E (non-dimensional) of the fluid; the volume fraction $\rho$ (kg/m$^3$) of the fluid; the temperature $T_a$ (° C.) of the annulus fluid; the total heat transfer coefficient $U_a$ (non-dimensional) of the annulus fluid and the stratum; the total heat transfer coefficient Ut (non-dimensional) of the annulus fluid and the drill pipe; the outer diameter $r_{co}$ (m) of the return pipeline; the inner diameter $r_{ti}$ (m) of the drill pipe; the heat conductivity coefficient $k_e$ (W/(m·° C.)) of the stratum; the transient heat transfer function $T_D$ (non-dimensional); the critical pressure $P_{ci(i=CO_2,\ H_2S)}$ (MPa) of the acid gases $CO_2$ and $H_2S$; the critical temperature $T_{pci(i=CO_2,\ H_2S)}$ (K) of the acid gases $CO_2$ and $H_2S$; the contents $y_{i(i\leq C_1,C_2,C_3)}$ (non-dimensional) of $C_1$, $C_2$ and $C_3$ gases in the gas phase; the Henry's constant $H_{i(i=C_1,\ C_2,\ C_3)}$ (non-dimensional) of the $C_1$, $C_2$ and $C_3$ gases in the liquid phase; the contents $y_{i(i=CO_2,H_2S)}$ (non-dimensional) of the $CO_2$ and $H_2S$ gases in the gas phase; the Henry's constant $H_{i(i=CO_2,\ H_2S)}$ (non-dimensional) of the $CO_2$ and $H_2S$ gases in the liquid phase; the bottom hole pressure $p_b$ (MPa) at the time t; and depth h (m).

1) A Gas Phase Continuity Equation

① stratum hydrocarbon gas $$\frac{\partial}{\partial t}\left(A\rho_g E_g + \frac{\sum_{i=C_1,C_2,C_3} R_i\rho_{gi}AE_o}{B_o}\right) + \frac{\partial}{\partial z}\left(A\rho_g v_g E_g + \frac{\sum_{i=C_1,C_2,C_3} R_i\rho_{gi}AE_o v_o}{B_o}\right) = q_g - x_g r_H$$

② $CO_2$ gas $$\frac{\partial}{\partial t}\left(A\rho_{CO_2}E_{CO_2} + \frac{R_{CO_2}\rho_{gCO_2}AE_o}{B_o}\right) + \frac{\partial}{\partial z}\left(A\rho_{CO_2}v_{CO_2}E_{CO_2} + \frac{R_{CO_2}\rho_{gCO_2}AE_o v_o}{B_o}\right) = q_{CO_2}$$

③ $H_2S$ gas $$\frac{\partial}{\partial t}\left(A\rho_{H_2S}E_{H_2S} + \frac{R_{H_2S}\rho_{gH_2S}AE_o}{B_o}\right) + \frac{\partial}{\partial z}\left(A\rho_{H_2S}v_{H_2S}E_{H_2S} + \frac{R_{H_2S}\rho_{gH_2S}AE_o v_o}{B_o}\right) = q_{H_2S}$$

2) A Liquid Phase Continuity Equation

① drilling fluid $$\frac{\partial}{\partial t}(A\rho_m E_m) + \frac{\partial}{\partial z}(A\rho_m v_m E_m) = -(1-x_g)r_H - r_{SC}$$

② stratum water $$\frac{\partial}{\partial t}(AE_w\rho_w) + \frac{\partial}{\partial z}(AE_w v_w\rho_w) = q_w$$

③ crude oil $$\frac{\partial}{\partial t}\left(AE_o\rho_o - \frac{\sum_{i=C_1,C_2,C_3,CO_2,H_2S} R_i\rho_{gi}AE_o}{B_o}\right) + \frac{\partial}{\partial z}\left(AE_o\rho_o v_o - A\frac{\sum_{i=C_1,C_2,C_3,CO_2,H_2S} R_i\rho_{gi}AE_o v_o}{B_o}\right) = q_0$$

3) A Solid Phase Continuity Equation

① rock debris $$\frac{\partial}{\partial t}(A\rho_c E_c) + \frac{\partial}{\partial z}(A\rho_c E_c v_c) = q_c$$

② hydrate phase $$\frac{\partial}{\partial t}(A\rho_H E_H)+\frac{\partial}{\partial z}(A\rho_H v_H E_H)=r_H$$

4) A Supercritical Phase Continuity Equation $$\frac{\partial}{\partial t}(A\rho_{SC}E_{SC})+\frac{\partial}{\partial z}(A\rho_{SC}v_{SC}E_{SC})=q_{SC}+r_{SC}$$

wherein the volume fraction of all the phases:

$$E_m+E_c+E_w+E_g+E_o+E_{CO_2}+E_{H_2S}+E_H+E_{SC}=1$$

5) A Momentum Equation $$\frac{\partial}{\partial t}\left[A\sum_{i=1}^{4}\left(\sum_{j=1}^{n}E_j\rho_j v_j\right)\right]+\frac{\partial}{\partial s}\left[A\sum_{j=1}^{4}\left(\sum_{j=1}^{n}E_j\rho_j v_j^2\right)\right]+Ag\cos\alpha\left[\sum_{j=1}^{4}\left(\sum_{j=1}^{n}E_j\rho_j\right)\right]+\frac{d(Ap)}{dz}+\frac{d(AF_r)}{dz}=0$$

6) An Energy Equation $$\frac{\partial}{\partial t}\left[\sum_{j=1}^{4}\left(\sum_{j=1}^{n}A\rho_j E_j C_j T_a\right)\right]+\frac{\partial}{\partial s}\left[\sum_{j=1}^{4}\left(\sum_{j=1}^{n}A\rho_j E_j w_j C_j T_a\right)\right]=2\left[\frac{2\pi r_{co}U_a k_e}{k_e+r_{co}U_a T_D}(T_{ei}-T)-2\pi r_{ti}U_t(T-T_t)\right]-\frac{r_H\Delta H_H}{M_H}-\frac{r_{SC}\Delta H_{SC}}{M_{SC}}$$

(4) Determination of a Core Auxiliary Equation and a Boundary Condition

1) A Core Auxiliary Equation

To accurately solve the established dual-multi model, it is necessary to combine with a hydrate formation equation, a gas solubility calculation equation and a supercritical judgment core auxiliary equation for solution, and it is also necessary to combine with a stratum fluid phase discrimination equation, a wellbore friction equation, a flow pattern judgment and a gas-liquid-solid three-phase slip equation and other models.

① A hydrate formation and decomposition equation:

$$r_H=(P,T)$$

② A gas solubility prediction equation:

$$R_{i(i=C_1,C_2,C_3)}=(T,P,y_{i(i=C_1,C_2,C_3)},H_{i(i=C_1,C_2,C_3)})$$

$$R_{i(i=CO_2,H_2S)}=(T,P,y_{i(i=CO_2,H_2S)},H_{i(i=CO_2,H_2S)})$$

③ A supercritical phase judgment equation:

$$\begin{cases}P\geq P_{pci(i=CO_2,H_2S)}\\T\geq T_{pci(j=CO_2,H_2S)}\end{cases}$$

2) An Initial Boundary Condition

Solution of a stratum temperature field: the wellhead temperature is read through measurement, the stratum temperature, that is, $T_h=T_o+\Delta Th$ at the current drilling well depth h is obtained according to the temperature gradient ΔT of the stratum, and the temperature serves as the initial temperature at the time t.

When no overflow occurs, normal drilling is performed:

$$E_o(z,0)=E_w(z,0)=E_H(z,0)=E_{H_2S}(z,0)=E_{CO_2}(z,0)=E_g(z,0)=E_{SC}(z,0)=0$$

$$E_c(z,0)=\frac{v_{sc}(z,0)}{C_c v_{sl}(z,0)+v_{cr}(z,0)}$$

$$E_m=1-E_c$$

wherein $v_{sc}$, $v_{sl}$ and $v_{cr}$ are the drift velocity (kg/m$^3$) of rock debris, liquid phase and rock debris settlement; $C_c$ is a velocity distribution coefficient Under the drilling overflow working condition and the drilling stoppage cyclic working condition, the initial boundary condition is:

① the drilling overflow working condition $$\begin{cases}p(h,t)=p_b\\q_g(h,t)=q_g\\q_w(h,t)=q_w\\q_c(h,t)=q_c\\q_s(h,t)=q_s\\q_{SC}(h,t)=q_{SC}\end{cases}$$

② the drilling stoppage cyclic working condition $$\begin{cases}p(h,t)=p_b\\q_g(h,t)=q_g\\q_w(h,t)=q_w\\q_c(h,t)=0\\q_s(h,t)=q_s\\q_{SC}(h,t)=q_{SC}\end{cases}$$

(5) Grid Partition and Numerical Discrete of a Solution Domain of the Dual-Multi Model 1) To accurately solve the multi-component and multi-phase flow control equation sets established in 3 and 4, it is necessary to perform space domain and time domain grid partition on a definite solution domain. The space grid of the wellbore annulus is subjected to fixed step length division, wherein any grid length: $\Delta z_i=z_{i+1}-z_i$. To track the front of the multi-phase flow in real time, the time step length Δt is obtained according to the relationship between the velocity $v_g$ of free gas and the space grid length $\Delta z_i$ at this position:

$$\Delta t=\frac{\Delta z_i}{v_g}$$

2) the Multi-Component and Multi-Phase Flow Control Equation Set in the Wellbore is Subjected to Numerical Discrete The established dual-multi model (the continuity equations, the momentum equation and the energy equation) is subjected to numerical discrete by a finite difference method. According to the characteristic of the time domain and the space domain in the wellbore, a four-point difference format is adopted. By taking the continuity equation of the rock debris as an example, the four-point difference discrete equation is as follows:

$$(AE_c\rho_c u_c)_{j+1}^{n+1} - (AE_c\rho_c u_c)_j^{n+1} = \frac{\Delta z}{2\Delta t}[(AE_c\rho_c)_j^n + (AE_c\rho_c)_{j+1}^n - (AE_c\rho_c)_j^{n+1} - (AE_c\rho_c)_{j+1}^{n+1}] + \frac{\Delta z}{2}[q_{cj}^{n+1} + q_{cj+1}^{n+1}]$$

Figure 2:
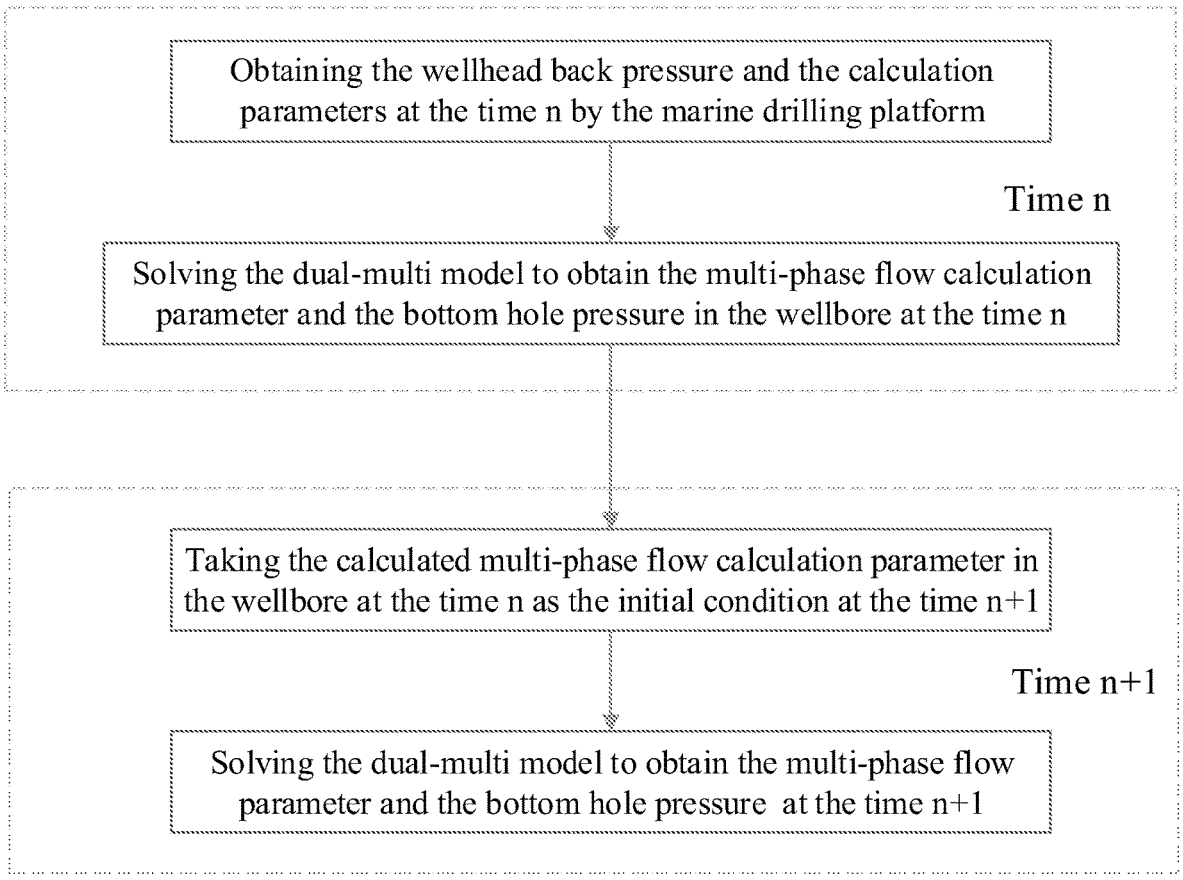
FIG. 2 is a flowchart of solving a dual-multi model to obtain a bottom hole pressure according to an embodiment of the present invention.

(6) Calculation of the Bottom Hole Pressure Under the Wellhead Back Pressure at the Current Time by the Dual-Multi Model The solution of the dual-multi model is as same as the existing computer solution, as shown in FIG. 2, the marine drilling platform obtains the wellhead back pressure and the calculation parameter at the time n, and the multi-phase flow parameters and the bottom hole pressure in the wellbore at the time n are obtained by solving the dual-multi model. The multi-phase flow parameters comprise temperature and pressure distribution at different positions of a riser and the stratum and the volume fraction and velocity distribution of each phase and each component. If it is necessary to predict the bottom hole pressure at the next time n+1, the calculated multi-phase flow parameters in the wellbore at the time n may serve as the initial condition of the time n+1. The multi-phase flow parameter and the bottom hole pressure at the time n+1 are obtained by solving the dual-multi model.

Figure 3:
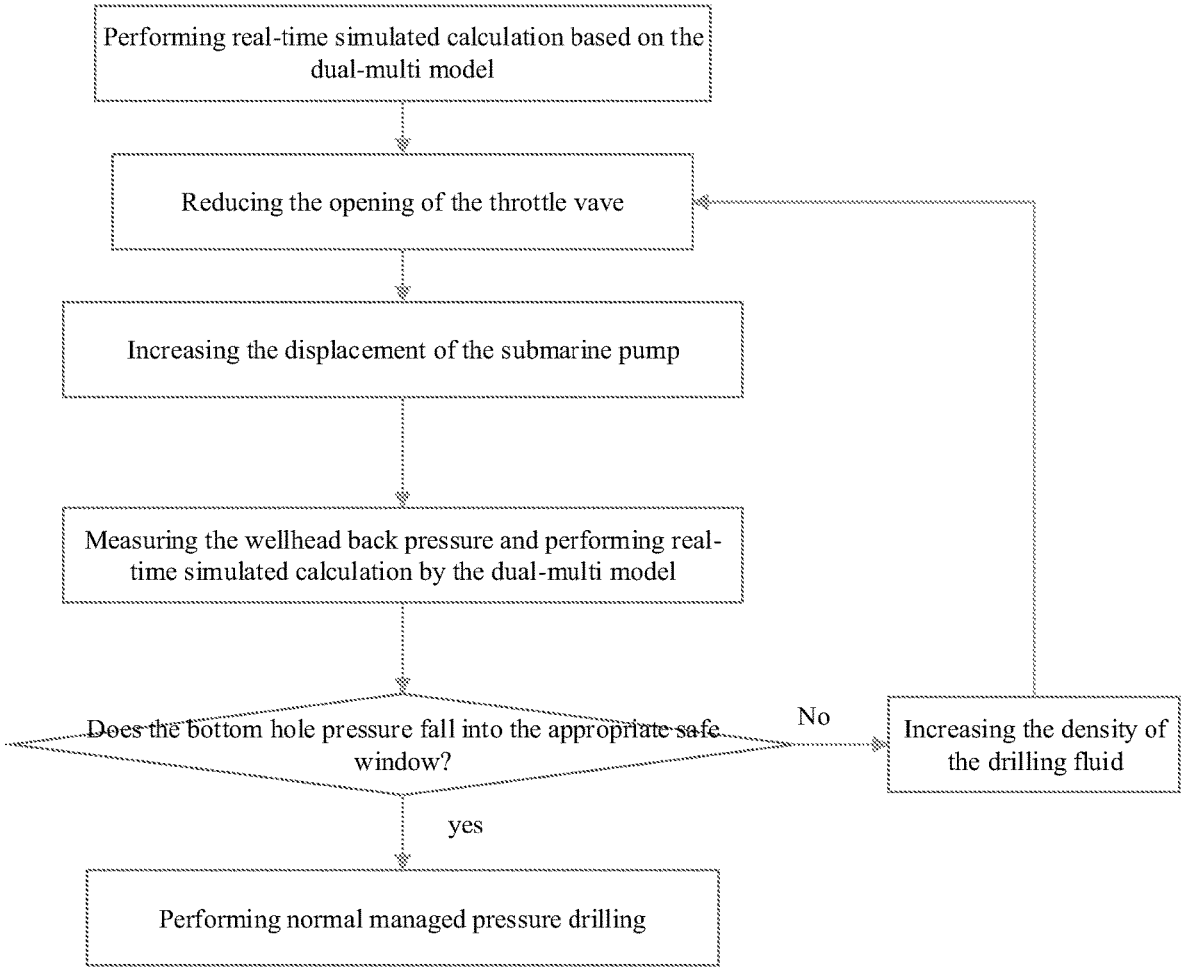
FIG. 3 is a flowchart of optimization of hydraulic parameters based on a dual-multi model in an overflow state.

5. Realizing Safe Drilling of the Deepwater Managed Pressure Drilling by Combining the Three Pressure Prediction Profiles of the Stratum and the Real-Time Simulated Calculation by the Dual-Multi Model The opening of the throttle valve and the displacement of the submarine pump are adjusted in real time based on the real-time simulated calculation by the dual-multi model, and managed pressure drilling is continued by combining the method of adjusting the density of the drilling fluid in real time. The specific steps are shown in FIG. 3. When downhole overflow is monitored to occur, the opening of the throttle valve on the throttle pipeline is reduced and the wellhead back pressure is increased; meanwhile, the displacement of the submarine pump is increased and the displacement of the drilling fluid is increased. The bottom hole pressure of the wellhead back pressure at the current time is calculated by the dual-multi model. In combination with the prediction judgment of the three pressure profiles, if overflow continues, drilling fluid with higher density relative to the original drilling fluid is mixed with the original drilling fluid and the mixture is pumped into the wellbore annulus from the drill pipe for drilling; meanwhile, the bottom hole pressure is calculated in real time by the multi-component and multi-phase flow model until the bottom hole pressure falls into an appropriate pressure window, wherein the density of the mixed drilling fluid is determined by the following formula:

$$\rho_{mix} = \frac{V_m\rho_m + V_h\rho_h}{(V_m + V_h)}$$

wherein $\rho_{mix}$ is the density (g/cm$^3$) of the mixed drilling fluid; $V_m$ is the volume (cm$^3$) of the drilling fluid used during drilling in the mud pit; $V_h$ (cm$^3$) is the volume of the used drilling fluid with high density; $\rho_m$ (g/cm$^3$) is the density of the drilling fluid during drilling; and $\rho_h$ (g/cm$^3$) is the concentration of the drilling fluid with high density.

Figure 4:
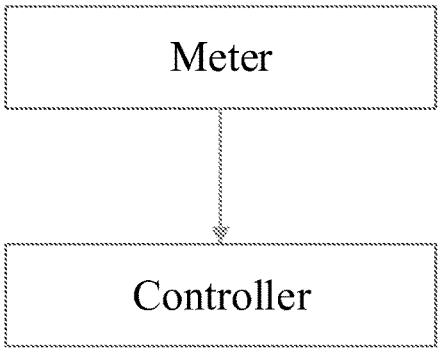
FIG. 4 is a structural schematic diagram of equipment for optimizing hydraulic parameters in real time based on a dual-multi model and big data fusion according to an embodiment of the present invention.

FIG. 4 is a structural schematic diagram of equipment for optimizing hydraulic parameters in real time based on a dual-multi model and big data fusion according to an embodiment of the present invention. As shown in FIG. 4, the equipment comprises: a meter configured to measure overflow parameters and a wellhead back pressure in the current drilling process in real time; and a controller configured to perform preprocessing and feature extraction on the overflow parameters, inputting the overflow parameters after preprocessing and feature extraction into trained support vector machine identification models for overflow judgment, when it is judged that overflow occurs at the current drilling depth, perform the following operations: reducing the opening of a throttle valve on a throttle pipeline, increasing the wellhead back pressure and increasing a displacement of a submarine pump and a displacement of drilling fluid, calculating a bottom hole pressure according to the collected wellhead back pressure, and judging whether overflow continues to occur in case that the calculated bottom hole pressure does not fall into a safety window; and under the condition that overflow continues to occur, mixing high-density drilling fluid with the original drilling fluid, pumping the mixture into a wellbore annulus from a drill pipe and performing the above operations of reducing the opening of the throttle valve, increasing the displacement of the submarine pump, calculating the bottom hole pressure and judging whether overflow continues to occur until overflow no longer occurs.

The components, the performed operations and the relevant benefits of the equipment can be referenced to the description of the method for optimizing the hydraulic parameters of the deepwater managed pressure drilling in real time based on the dual-multi model and big data fusion, which are not elaborated herein.

It should also be noted that the term "comprise", "include", or any other variant thereof is intended to cover a non-exclusive inclusion, such that a process, method, product, or device that includes a series of elements includes not only those elements, but also other elements not explicitly listed, or elements that are inherent to such a process, method, product, or device.

Without more restrictions, an element defined by the phrase "comprising a . . . " does not exclude the presence of another same element in a process, method, product, or device that includes the element.

The above is only an embodiment of the present application and is not intended to limit the present application. For those skilled in the art, the present application may have various modifications and changes. Any modifications, equivalent substitutions, improvements, etc. made within the spirit and principle of the present application should be included within the scope of the claims of the present application.

What is claimed:

1. A method for optimizing hydraulic parameters of deepwater managed pressure drilling in real time, the method comprising:

acquiring overflow parameters in the current drilling process in real time, performing preprocessing and feature extraction on the overflow parameters, and inputting the overflow parameters after preprocessing and feature extraction into trained support vector machine identification models for overflow judgment; and when it is judged that overflow occurs at the current drilling depth, reducing the opening of a throttle valve on a throttle pipeline, increasing a wellhead back pressure and increasing a displacement of a submarine pump and a displacement of drilling fluid;

measuring the wellhead back pressure and calculating a bottom hole pressure according to the measured wellhead back pressure;

judging whether overflow continues to occur in case that the calculated bottom hole pressure does not fall into a safety window; and under the condition that overflow continues to occur, mixing high-density drilling fluid with the original drilling fluid, pumping the mixture into a wellbore annulus from a drill pipe, and performing the above operations of reducing the opening of the throttle valve, increasing the displacement of the submarine pump, calculating the bottom hole pressure and judging whether overflow continues to occur until overflow no longer occurs, wherein, the trained support vector machine identification models comprise: a flow identification model, a mud pit increment identification model and a standpipe pressure identification model; and the step of acquiring overflow parameters in the current drilling process in real time, performing preprocessing and feature extraction on the overflow parameters, and inputting the overflow parameters after preprocessing and feature extraction into trained support vector machine identification models for overflow judgment comprises:

acquiring a flow differential of an inlet and an outlet, a mud pit increment and a standpipe pressure in the current drilling process in real time, performing preprocessing and feature extraction on the flow differential, the mud pit increment and the standpipe pressure, inputting the flow differential, the mud pit increment and the standpipe pressure after preprocessing and feature extraction into corresponding support vector machine identification models for overflow judgment, and processing an overflow probability under each identification model by an information fusion model to judge whether overflow occurs at the current drilling well depth.

2. The method according to claim 1, wherein the step of calculating the bottom hole pressure according to the measured wellhead back pressure comprises:

determining flow calculation parameters after overflow of the managed pressure drilling;

determining complex fluid components in the overflow state;

establishing a wellbore dual-multi model by considering the complex flow in a wellbore in the overflow state;

determining a core auxiliary equation and a boundary condition;

performing grid partition and numerical discrete on a solution domain of the dual-multi model; and solving the dual-multi model to obtain the bottom hole pressure under the current measured wellhead back pressure.

3. The method according to claim 2, wherein the flow calculation parameters comprise: a wellbore structure, a drilling tool assembly, stratum data, a gas-liquid-solid phase displacement monitored on a drilling platform, a drilling fluid density, a drilling fluid viscosity, the wellhead back pressure, a wellhead temperature and pressure and the current drilling depth of a drill bit;

the complex fluid components comprise: drilling fluid, inflow crude oil, stratum water, broken rock debris, hydrate, hydrocarbon gas, $CO_2$ and $H_2S$ when a hydrate layer is drilled through.

4. The method according to claim 2, wherein the wellbore dual-multi model comprises: a gas phase continuity equation, a liquid phase continuity equation, a solid phase continuity equation, a supercritical phase continuity equation, a momentum equation,_ and an energy equation.

5. Equipment for optimizing hydraulic parameters of deepwater managed pressure drilling in real time, the equipment comprising:

a meter configured to measure overflow parameters and a wellhead back pressure in the current drilling process in real time; and a controller configured to perform preprocessing and feature extraction on the overflow parameters, inputting the overflow parameters after preprocessing and feature extraction into trained support vector machine identification models for overflow judgment, when it is judged that overflow occurs at the current drilling depth, perform the following operations:

reducing the opening of a throttle valve on a throttle pipeline, increasing a wellhead back pressure and increase a displacement of a submarine pump and a displacement of drilling fluid, calculating a bottom hole pressure according to a collected wellhead back pressure, judging whether overflow continues to occur in case that the calculated bottom hole pressure does not fall into a safety window; and under the condition that overflow continues to occur, mixing high-density drilling fluid with the original drilling fluid, pumping the mixture into a wellbore annulus from a drill pipe, and performing the above operations of reducing the opening of the throttle valve, increasing the displacement of the submarine pump, calculating the bottom hole pressure and judging whether overflow continues to occur until overflow no longer occurs, wherein, the trained support vector machine identification models comprise: a flow identification model, a mud pit increment identification model and a standpipe pressure identification model;

the meter is configured to measure a flow differential of an inlet and an outlet, a mud pit increment and a standpipe pressure in the current drilling process in real time; and the controller is configured to perform preprocessing and feature extraction on the flow differential, the mud pit increment and the standpipe pressure, input the flow differential, the mud pit increment and the standpipe pressure after preprocessing and feature extraction into corresponding support vector machine identification models for overflow judgment to obtain an overflow probability under each identification model, and process the overflow probability under each identification model by an information fusion model to judge whether overflow occurs at the current drilling well depth.

6. The equipment according to claim 5, wherein the operation of calculating the bottom hole pressure according to the measured wellhead back pressure comprises:

determining flow calculation parameters after overflow of the managed pressure drilling;

determining complex fluid components in the overflow state;

establishing a wellbore dual-multi model by considering the complex flow in a wellbore in the overflow state;

determining a core auxiliary equation and a boundary condition;

performing grid partition and numerical discrete on a solution domain of the dual-multi model; and solving the dual-multi model to obtain the bottom hole pressure under the current measured wellhead back pressure.

7. The equipment according to claim 6, wherein the flow calculation parameters comprise: a wellbore structure, a drilling tool assembly, stratum data, a gas-liquid-solid phase displacement monitored on a drilling platform, a drilling fluid density, a drilling fluid viscosity, the wellhead back pressure, a wellhead temperature and pressure and the current drilling depth of a drill bit;

the complex fluid components comprise: drilling fluid, inflow crude oil, stratum water, broken rock debris, hydrate, hydrocarbon gas, $CO_2$ and $H_2S$ when a hydrate layer is drilled through.

8. The equipment according to claim 6, wherein the wellbore dual-multi model comprises: a gas phase continuity equation, a liquid phase continuity equation, a solid phase continuity equation, a supercritical phase continuity equation, a momentum equation, and an energy equation.

* * * * *